US010065291B2

(12) United States Patent
Kousens et al.

(10) Patent No.: US 10,065,291 B2
(45) Date of Patent: Sep. 4, 2018

(54) REVERSIBLE FACE PLATE FOR VISE JAWS

(71) Applicant: Chicago Equipment Leasing Services Company, La Jolla, CA (US)

(72) Inventors: WIlliam Kousens, El Cajon, CA (US); Zachary Kousens, Carlsbad, CA (US); Tam Nguyen, San Diego, CA (US)

( * ) Notice: Subject to any disclaimer, the term of this patent is extended or adjusted under 35 U.S.C. 154(b) by 95 days.

(21) Appl. No.: 14/986,074

(22) Filed: Dec. 31, 2015

(65) Prior Publication Data

US 2017/0190024 A1 Jul. 6, 2017

(51) Int. Cl.
*B25B 1/00* (2006.01)
*B25B 1/24* (2006.01)

(52) U.S. Cl.
CPC ..... *B25B 1/2452* (2013.01)

(58) Field of Classification Search
CPC ..... B25B 1/2452; Y10T 29/53961; Y10T 29/5397; Y10T 29/53983; Y10T 29/53991
See application file for complete search history.

(56) References Cited

U.S. PATENT DOCUMENTS

| | | | | |
|---|---|---|---|---|
| 2,810,600 | A | 10/1957 | Kendrick | |
| 3,077,346 | A | 2/1963 | Lassy | |
| 4,898,371 | A | 2/1990 | Mills et al. | |
| 5,078,372 | A | 1/1992 | Fitzpatrick | |
| 6,022,010 | A | 2/2000 | Bernstein | |
| 6,971,643 | B1 * | 12/2005 | Garrison | B25B 1/2405 269/282 |

* cited by examiner

*Primary Examiner* — Richard Chang
(74) *Attorney, Agent, or Firm* — Buche & Associates, P.C.; John K. Buche; Bryce A. Johnson

(57) ABSTRACT

Disclosed generally is a quick change face plate for a vise.

3 Claims, 6 Drawing Sheets

REVERSIBLE FACE PLATE FOR VISE JAWS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of Invention

The disclosed subject matter relates generally to a vise for machining work pieces. More particularly, said subject matter is a reversible face plate.

Background of the Invention

Work pieces are customarily secured against movement between the jaws of a vise during machining. FIG. 1 illustrates a common vise 100 with: a jaw 110 and two face plates 111, 112; and a crank 120 for moving the movable jaw 110 between open and closed positions. In the most basic scenario, a work piece (not shown) is simply clamped or pressed between the two-face plates 111, 112 by turning the crank 120 to drive the movable jaw 110*a* toward the stationary jaw 110*b*. Frequently, face plates with differing work-surface qualities or characters are required for particular work pieces. For this reason, face plates 111, 112 of common vises 100, are preferably interchangeable (e.g., via removing screws) to enable a user to swap face plates having a variety of working surfaces for customized holding of a particular work piece.

Vise jaws exist that utilizes various versions of keyhole slot connections to enable quick changing of faceplates. Keyhole connections are well known in the art as an expedient for rapidly joining a pair of members. See, e.g., U.S. Pat. No. 2,810,600 by Kendrick (circa 1954). These keyhole connections incorporate one or more slots in a first member which is adapted to be secured to a second member by screws or bolts. In these typical keyhole slots, the slots are each formed with an enlarged portion which will pass the bolt head and a portion which is reduced in width to pass the bolt shank but not the head. U.S. Pat. No. 5,078,372 by Fitzpatrick discloses a face place that uses a modified keyhole connection where the head and shank of a bolt are slid vertically through the keyhole slot before being tightened to the jaw via passing a tool through the working surface of the face plate. See FIGS. 4 and 5 of Fitzpatrick. U.S. Pat. No. 6,022,010 by Bernstein discloses a face place that uses a modified keyhole connection where the head and shank of a bolt are inserted into the slot then slid into the reduced portion where the bolt is tightened via pulling the bolt toward the jaw without passing a tool through the working surface of the face plate. See FIGS. 15 and 16 of Bernstein. Although these disclosures enable quickly changed faceplates, they do not enable the fastest possible faceplate exchange because (a) the replacement face plate must be specifically oriented to accomplish the keyhole connection to the jaw and (b) time may be lost during orientation of the face plate. In view of the foregoing, a need exits for quickly changeable faceplates that reduce or eliminate the time required for orientation of a keyhole connection.

SUMMARY OF THE INVENTION

In view of the forgoing, it is an objective of this specification to disclose a face plate for a vise that is capable of quick orientation for keyhole interconnection with a vise jaw. In one embodiment, the disclosed subject matter is a reversible vise face plate comprising: a plate with a front and back; and at least one keyhole bore and keyhole slot defined through the plate and accessible from the front or back of the plate, where the keyhole slot features a recess that is completely enclosed and within the periphery of the plate. In use, the disclosed faceplate may be installed on a vise jaw by either:

(1) passing the head of a bolt into the keyhole bore from the front of the plate and sliding the shank of the bolt along the slot until the head of the bolt resides within the enclosed recess and (b) tightening the bolt against the recess by using a tool that interacts with the bolt head through the slot on the back of the face plate; OR (2) passing the head of a bolt into the keyhole bore from the back of the plate and sliding the shank of the bolt along the slot until the head of the bolt resides within the enclosed recess and (b) tightening the bolt against the recess by using a tool that interacts with the bolt head through the slot on the front of the face plate.

BRIEF DESCRIPTION OF THE FIGURES

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed generally is a face plate for a vise that is capable of quick orientation for keyhole interconnection with a vise jaw. In one embodiment, the disclosed subject matter is a reversible vise face plate comprising: a plate with a front and back; and at least one keyhole bore and keyhole slot defined through the plate and accessible from the front or back of the plate, where the keyhole slot features a recess that is completely enclosed and within the periphery of the plate. In use, the disclosed faceplate may be installed on a vise jaw by either:

(1) passing the head of a bolt into the keyhole bore from the front of the plate and sliding the shank of the bolt along the slot until the head of the bolt resides within the enclosed recess and (b) tightening the bolt against the recess by using a tool that interacts with the bolt head through the slot on the back of the face plate; OR (2) passing the head of a bolt into the keyhole bore from the back of the plate and sliding the shank of the bolt along the slot until the head of the bolt resides within the enclosed recess and (b) tightening the bolt against the recess by using a tool that interacts with the bolt head through the slot on the front of the face plate.

Figure 1:
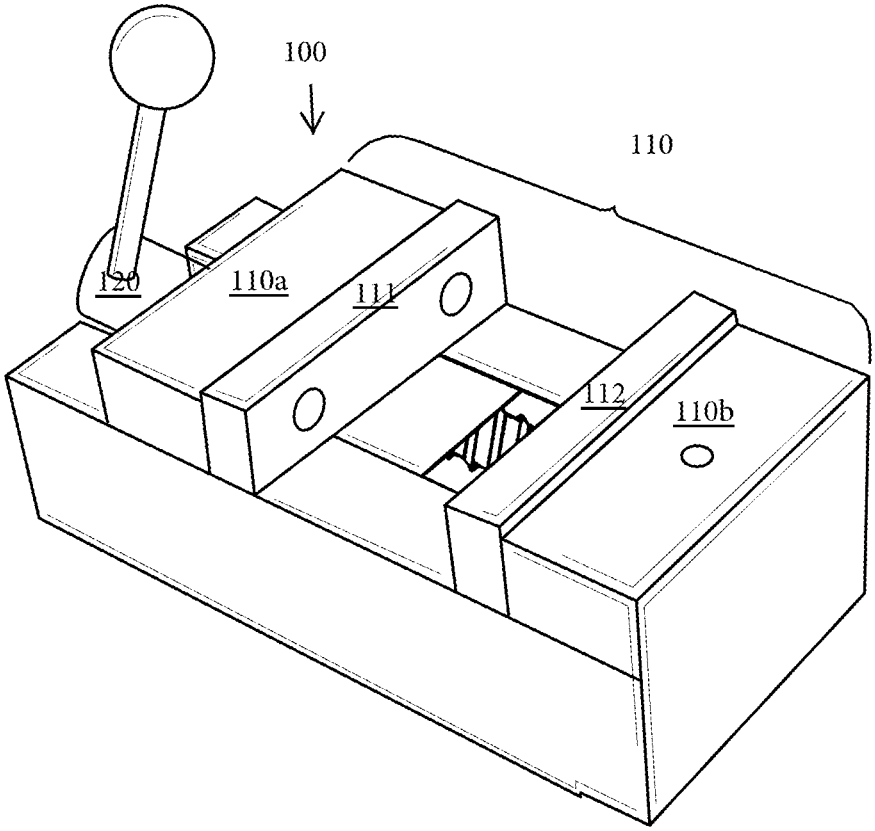
FIG. 1 (Prior Art)
FIG. 1 is a perspective view of a common vise 100 of a prior art vise.
Figure 2:
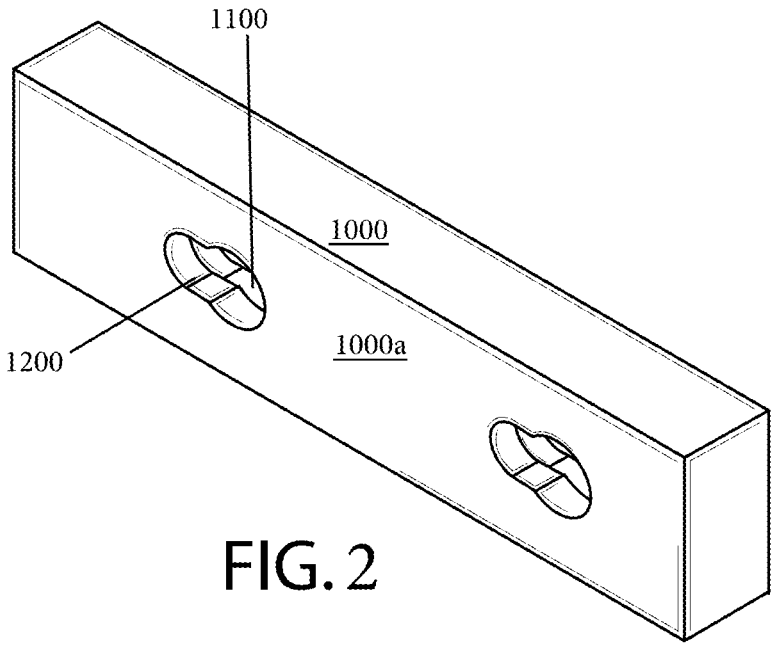
FIG. 2 is a front perspective of a face plate 1000.
Figure 3:
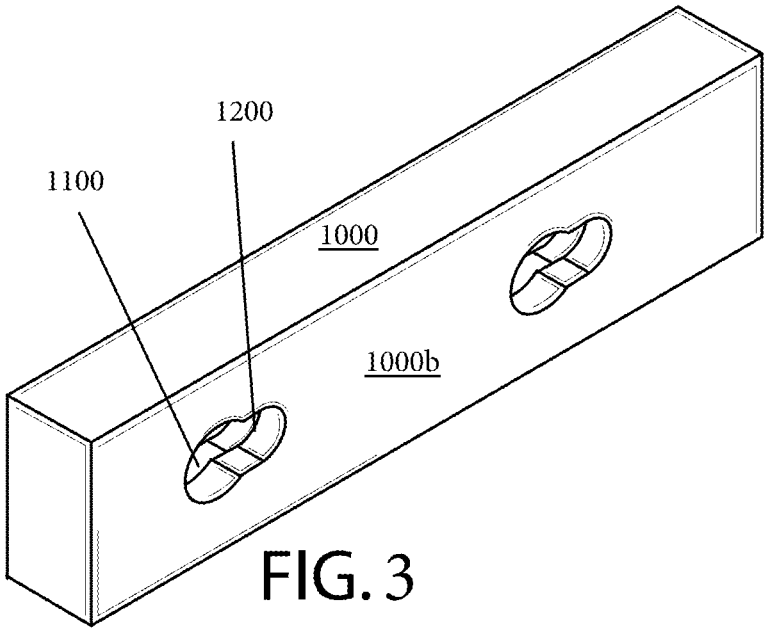
FIG. 3 is a back perspective of the face plate 1000 of FIG. 2.
Figure 4:
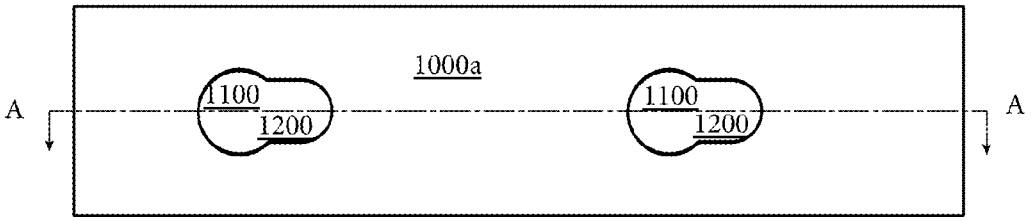
FIG. 4 is a front view of the face plate 1000 of FIGS. 2 and 3.
Figure 5:
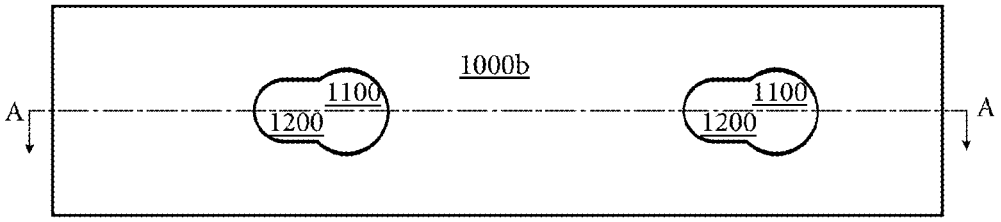
FIG. 5 is a back view of the face plate 1000 of FIGS. 1 through 4.
Figure 6:
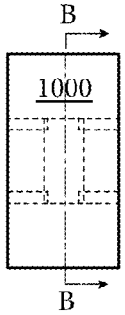
FIG. 6 is an either side view of the compensating face plate 1000 of FIGS. 1 through 5.

FIG. 2 is a front perspective of a face plate 1000. FIG. 3 is a rear perspective of the face plate 1000. FIG. 4 is a front view of the face plate 1000. FIG. 5 is a back view of the face plate 1000. FIG. 6 is an either side view of the face plate 1000. As shown in these figures, the face plate 1000 may be a block with a front face 1000*a* and a back face 1000*b*. Suitably, the block features a keyhole bore 1100 and a keyhole slot 1200 that pass through the block from the front face 1000*a* to the back face 1000*b*.

Figure 7:
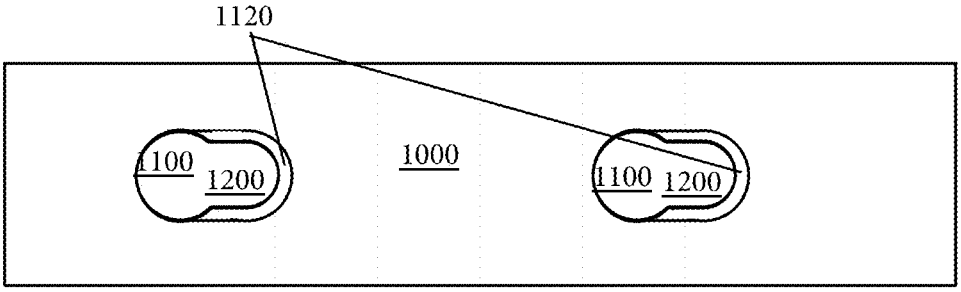
FIG. 7 is a cross section of the face plate 1000 of FIG. 6 along line B-B.
Figure 8:
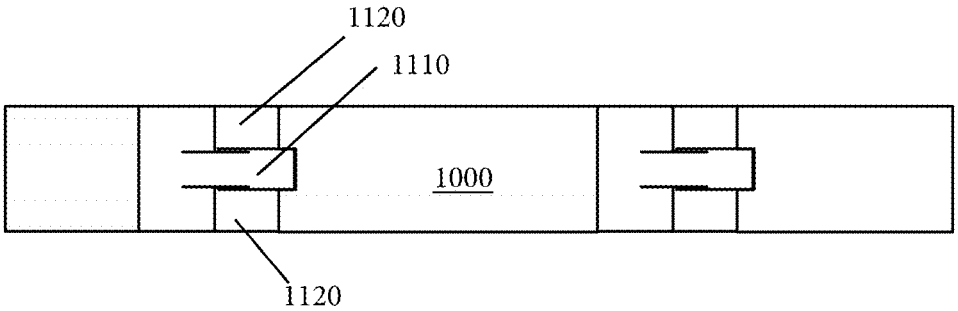
FIG. 8 is a cross section of the face plate 1000 of FIGS. 4 and 5 along line A-A.

FIG. 7 is a cross section of the face plate 1000 of FIG. 6 along line B-B. FIG. 8 is a cross section of the face plate 1000 of FIGS. 4 and 5 along line A-A. In these figures, the slot 1200 is shown to interconnect with a recess 1110 (FIG. 8) that is completely enclosed and within the periphery of the plate 1000. Suitably, the recess 1110 and the slot 1200 define a collar 1120 in the front side and the back side of the plate 1000.

Figure 9:
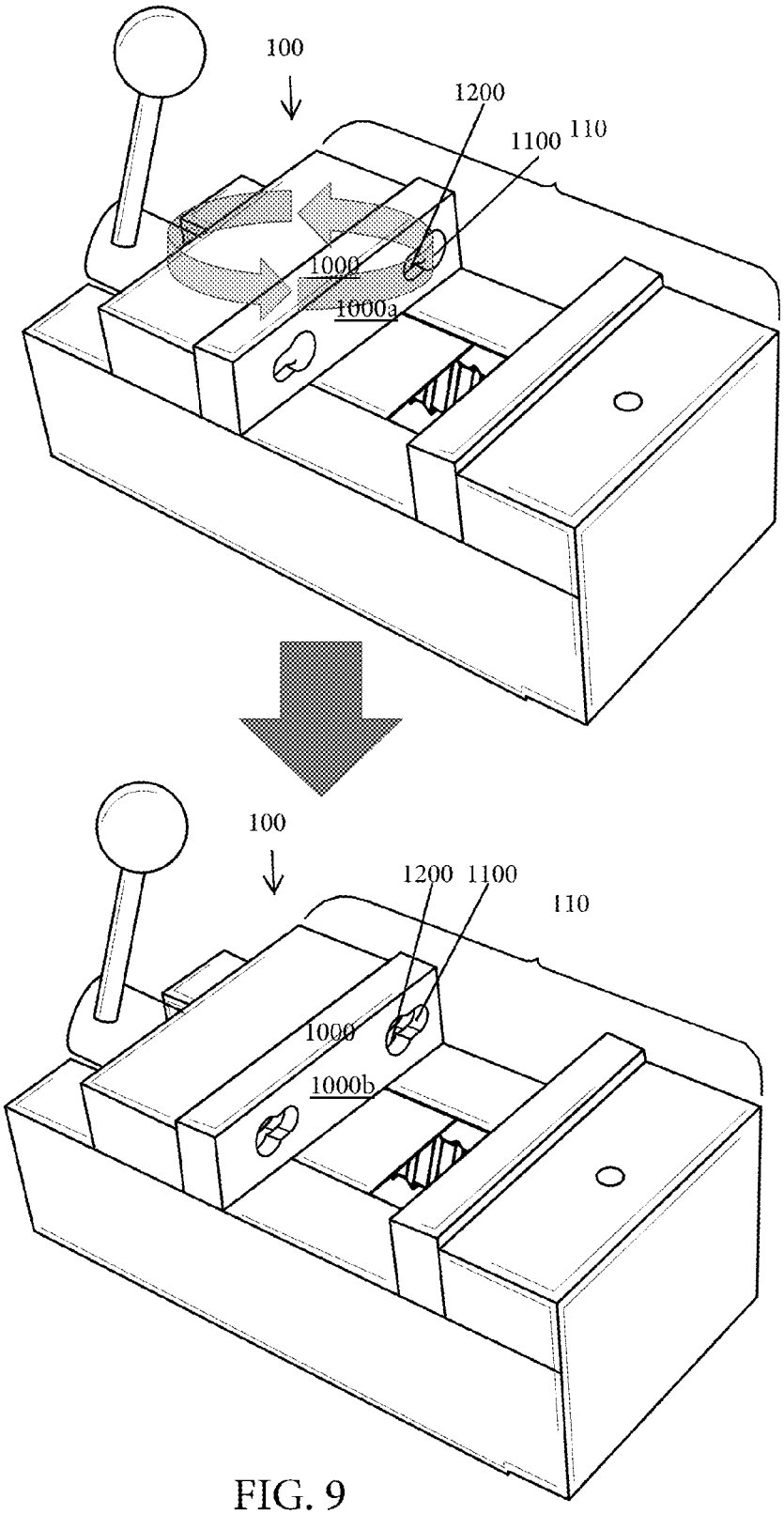
FIG. 9 is a diagram for using the face plate 1000 of FIGS. 1 through 8.
Figure 10:
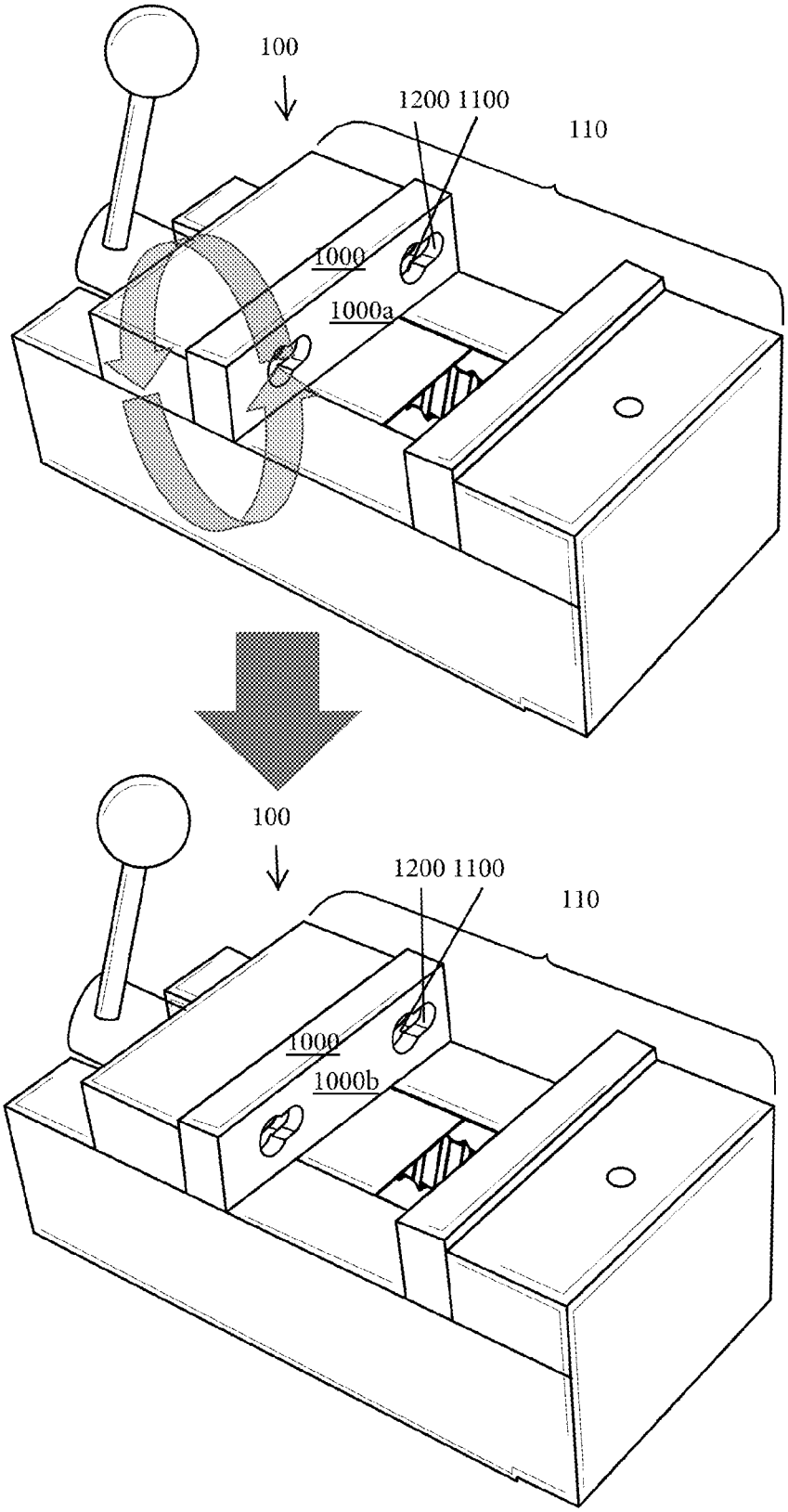
FIG. 10 is another diagram for using the faceplate of FIGS. 1 through 8.

In use, the disclosed faceplate 1000 is installed on a vise jaw (a) through either the front 1000*a* or back 1000*b* face and with any orientation and (b) with any vertical orientation. This operation is illustrated by the diagrams presented in FIGS. 9 and 10. Referring first to the top portion of FIG. 9, a face plate may be installed on a vise 100 within the jaw 110 as shown. A tool may be inserted into the bore 1100 or slot 1200 through the front face 1000*a* to loosen a bolt (not shown). The bolt may be slid through the slot 1200 and passed from the back surface 1000*b* (not shown in the top portion of FIG. 9) to remove the face plate 1000. Transitioning from the top of FIG. 9 to the bottom of FIG. 9, the face plate 1000 may be rotated as illustrated by the arrows in the upper portion so that the faceplate 1000 can be installed by passing the bolt (not shown) into the keyhole bore 1100 through the front face (not shown in the bottom portion of FIG. 9), slid along the slot 1200 and secured to the vise by a tool operating through the slot 1200 on the back side 1000*b* of the face plate. Referring now to the top portion of FIG. 10, a face plate 1000 may be installed on a vise 100 within the jaw 110 as shown. A tool (not shown) may be inserted into the slot 1200 through the front face 1000*a* to loosen a bolt (not shown). The shank of the bolt (not shown) may be slid through the slot 1200 and passed from the back surface 1000*b* (not shown in the top portion of FIG. 9) to remove the face plate 1000 from the vise 100. Transitioning from the top of FIG. 10 to the bottom of FIG. 10, the face plate 1000 may be rotated as illustrated by the arrows in the upper portion of the figure so that the face plate 1000 can be installed by passing the bolt (not shown) into the keyhole bore 1100 through the front face (not shown in the bottom portion of FIG. 9), slid along the slot 1200 and secured to the vise by a tool (not shown) operating through the slot 1200 on the back side 1000*b* of the face plate 1000.

In summary, the face plate 1000 may be used by either:

(1) passing the head of a bolt into the keyhole bore from the front of the plate and sliding the shank of the bolt along the slot until the head of the bolt resides within the enclosed recess and (b) tightening the bolt against the recess by using a tool that interacts with the bolt head through the slot on the back of the face plate; OR (2) passing the head of a bolt into the keyhole bore from the back of the plate and sliding the shank of the bolt along the slot until the head of the bolt resides within the enclosed recess and (b) tightening the bolt against the recess by using a tool that interacts with the bolt head through the slot on the front of the face plate.

The utility model is described according to one embodiment. Without departing from the principles of the utility model, the device can be adjusted to accomplish various other embodiments. It should be pointed out that any technical solution or equivalent transformation all fall within the scope of the protection of utility models. It is to also be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

While the invention has been shown in a preferred embodiment, including a generally tubular or inverted truncated cone-shaped cup, it is recognized that departures may be made in the form of the cup and the mating matching rings to accommodate a square-shaped cup, for example; and it is further recognized that departures may be made from the invention as described within the spirit of this invention which is therefore not to be limited except as set forth in the claims which follow.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A reversible face plate comprising:

a block with a front face and a back face;

a first keyhole bore and a first keyhole slot that extends from a side of the first keyhole bore, where the first keyhole bore and first keyhole slot are defined through the block and defined on both the front face and the back face of the block;

a first recess around the first keyhole slot and defined inside the block between the front face and the back face of the block to form a first collar;

a second keyhole bore and a second keyhole slot that extends from a side of the second keyhole bore, where the second keyhole bore and second keyhole slot are defined through the block and defined on both the front face and the back face of the block;

a second recess around the second keyhole slot and defined inside the block between the front face and the back face of the block to form a second collar.

2. A method of using a reversible face plate comprising the steps of:

locating the reversible face plate defined by a block with a front face and a back face; and locating a first keyhole bore and a first keyhole slot that extends from a side of the first keyhole bore, where the first keyhole bore and first keyhole slot are defined through the block and defined on both the front face and the back face of the block;

locating a first recess around the first keyhole slot and defined inside the block between the front face and the back face of the block to form a first collar;

locating a second keyhole bore and a second keyhole slot that extends from a side of the second keyhole bore, where the second keyhole bore and second keyhole slot are defined through the block and defined on both the front face and the back face of the block;

locating a second recess around the second keyhole slot and defined inside the block between the front face and the back face of the block to form a second collar passing a head of a bolt into the first keyhole bore from the front face;

sliding a shank of the bolt along the first keyhole slot until the head of the bolt resides within the first collar in between the front face and the back face of the block;

tightening the bolt against the first recess using a tool that interacts with the bolt head through the first keyhole slot from the back face of the block;

untightening the bolt from against the first recess using the tool that interacts with the bolt head through the first keyhole slot from the back face of the block;

sliding the shank of the bolt along the first keyhole slot until the head of the bolt exits the first collar and resides in the first keyhole bore;

passing the head of the bolt out of the first key hole bore from the front face of the block;

rotating the block widthwise;

passing the head of the bolt into the first keyhole bore from back face;

sliding the shank of the bolt along the first key hole slot until the head of the bolt resides within the first collar in between the front face and the back face of the block; and tightening the bolt against the first recess using the tool that interacts with the bolt head through the first keyhole slot on the from front face of the block.

3. A method of using a reversible face plate comprising the steps of:

locating the reversible face plate defined by a block with a front face and a back face; and locating a first keyhole bore and a first keyhole slot that extends from a side of the first keyhole bore, where the first keyhole bore and first keyhole slot are defined through the block and defined on both the front face and the back face of the block;

locating a first recess around the first keyhole slot and defined inside the block between the front face and the back face of the block to form a first collar;

locating a second keyhole bore and a second keyhole slot that extends from a side of the second keyhole bore, where the second keyhole bore and second keyhole slot are defined through the block and defined on both the front face and the back face of the block;

locating a second recess around the second keyhole slot and defined inside the block between the front face and the back face of the block to form a second collar passing a head of a bolt into the first keyhole bore from the front face;

sliding a shank of the bolt along the first keyhole slot until the head of the bolt resides within the first collar in between the front face and the back face of the block;

tightening the bolt against the first recess using a tool that interacts with the bolt head through the first keyhole slot from the back face of the block;

untightening the bolt from against the first recess using the tool that interacts with the bolt head through the first keyhole slot from the back face of the block;

sliding the shank of the bolt along the first keyhole slot until the head of the bolt exits the first collar and resides in the first keyhole bore;

passing the head of the bolt out of the first key hole bore from the front face of the block;

rotating the block lengthwise;

passing the head of the bolt into the second keyhole bore from back face;

sliding the shank of the bolt along the second key hole slot until the head of the bolt resides within the second collar in between the front face and the back face of the block; and tightening the bolt against the second recess using the tool that interacts with the bolt head through the first keyhole slot on the from front face of the block.

* * * * *